US008454828B2

(12) United States Patent
Wochele et al.

(10) Patent No.: US 8,454,828 B2
(45) Date of Patent: Jun. 4, 2013

(54) DISPENSING DEVICE

(75) Inventors: Matthias Wochele, Rielasingen-Worblingen (DE); Juergen Greiner-Perth, Gottmadingen (DE)

(73) Assignee: Aptar Radolfzell GmbH, Radolfzell (DE)

( * ) Notice: Subject to any disclaimer, the term of this patent is extended or adjusted under 35 U.S.C. 154(b) by 248 days.

(21) Appl. No.: 12/455,053

(22) Filed: May 28, 2009

(65) Prior Publication Data

US 2009/0294347 A1 Dec. 3, 2009

(30) Foreign Application Priority Data

Jun. 2, 2008 (DE) ..... 10 2008 027 146

(51) Int. Cl.
*A61J 1/20* (2006.01)

(52) U.S. Cl.
USPC ..... 210/245; 210/472; 222/189.09; 222/212

(58) Field of Classification Search
USPC ..... 210/244, 245, 472, 494, 495, 335, 210/436, 449, 463; 222/189.09, 212; 96/219; 55/385.4; 604/324
See application file for complete search history.

(56) References Cited

U.S. PATENT DOCUMENTS

| | | | | |
|---|---|---|---|---|
| 3,523,408 | A * | 8/1970 | Rosenberg | 96/6 |
| 3,838,691 | A * | 10/1974 | Paludan et al. | 604/323 |
| 4,512,771 | A | 4/1985 | Norton | |
| 4,972,865 | A | 11/1990 | Mattson | |
| 5,238,153 | A | 8/1993 | Castillo et al. | |
| 5,320,254 | A | 6/1994 | Ranalletta et al. | |
| 5,431,310 | A * | 7/1995 | Kanner et al. | 222/212 |
| 5,971,221 | A | 10/1999 | Schwarz | |
| 6,093,230 | A | 7/2000 | Johnson, III et al. | |
| 6,145,707 | A | 11/2000 | Baudin | |
| 7,201,296 | B2 | 4/2007 | Graf | |
| 7,249,694 | B2 * | 7/2007 | Masuda | 222/212 |
| 7,303,098 | B2 | 12/2007 | Backes | |
| 2003/0042211 | A1 | 3/2003 | Beplate | |
| 2005/0173456 | A1 | 8/2005 | Backes | |
| 2007/0113841 | A1 | 5/2007 | Fuchs | |
| 2007/0164051 | A1 | 7/2007 | Mijers et al. | |
| 2007/0284393 | A1 | 12/2007 | Ritsche et al. | |
| 2008/0067194 | A1 | 3/2008 | Faurie | |
| 2008/0302828 | A1 | 12/2008 | Pozzi | |
| 2009/0090689 | A1 * | 4/2009 | Walsh | 215/261 |
| 2010/0108712 | A1 * | 5/2010 | Manesis | 222/1 |

FOREIGN PATENT DOCUMENTS

| | | | |
|---|---|---|---|
| DE | 196 42 073 | A1 | 4/1998 |
| DE | 102 00 519 | A1 | 7/2003 |
| DE | 10 2004 044 344 | A1 | 3/2006 |
| EP | 0 500 249 | A1 | 8/1992 |
| EP | 0 864 371 | A1 | 9/1998 |
| EP | 0 908 395 | A1 | 4/1999 |

(Continued)

*Primary Examiner* — Matthew O Savage
(74) *Attorney, Agent, or Firm* — Flynn, Thiel, Boutell & Tanis, P.C.

(57) ABSTRACT

The invention relates to a dispensing device for a liquid medium, having a medium reservoir for accommodating the medium, having a dispensing opening for dispensing the medium from the medium reservoir, and having a pressure-equalizing channel which opens out into the medium reservoir and has a microbiologically active filter arrangement inserted therein.

Figure 1:
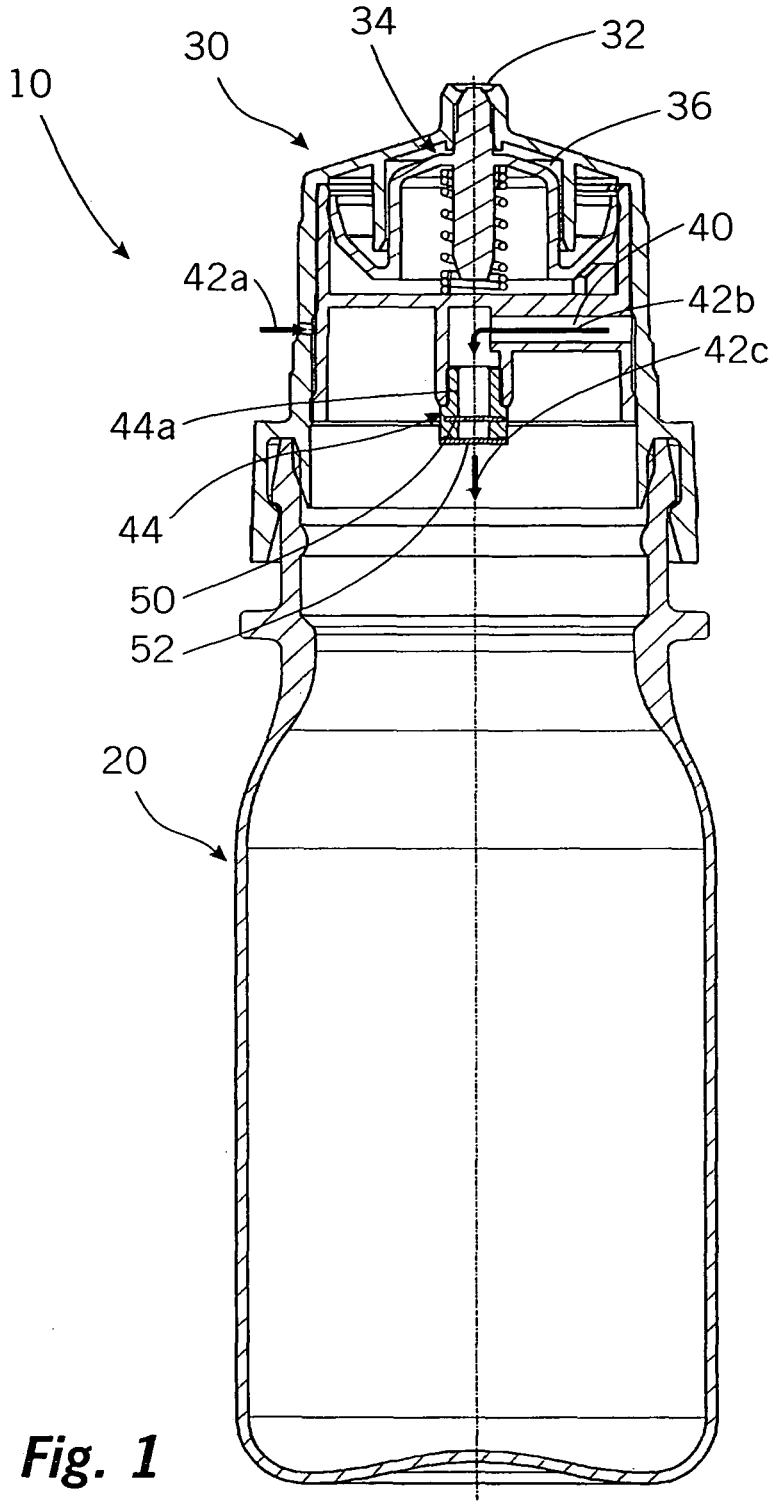

According to the invention, the filter arrangement has a liquid filter oriented in the direction of the medium reservoir and a bacteria filter oriented away from the medium reservoir.

11 Claims, 3 Drawing Sheets

FOREIGN PATENT DOCUMENTS

| | | | |
|---|---|---|---|
| EP | 1 773 676 | B1 | 4/2007 |
| EP | 1 682 056 | B1 | 4/2008 |
| JP | 2005-082234 | | 3/2005 |
| WO | WO 2005/123528 | A1 | 12/2005 |
| WO | WO 2007/028868 | A1 | 3/2007 |
| WO | WO 2007096526 | A2 * | 8/2007 |

* cited by examiner

DISPENSING DEVICE

APPLICATION AREA AND PRIOR ART

The invention relates to a dispensing device for a liquid medium, having a medium reservoir for accommodating the medium, a dispensing opening for dispensing the medium from the medium reservoir, and a pressure-equalizing channel which opens out into the medium reservoir and has a microbiologically active filter arrangement inserted therein.

Dispensing devices of the type in question are known from the prior art. They are used for pharmaceutical liquids, for example for eye drops and nose drops. In the case of the dispensing devices of the type in question, the dispensing operation leads to the quantity of medium located in the medium reservoir being reduced, in which case air has to flow in in order to prevent the medium reservoir from being subjected permanently to negative pressure.

For this purpose, the dispensing devices which are known from the prior art make provision for a pressure-equalizing channel to be led from the external surroundings to the medium reservoir, through which air can flow in. In order to prevent the medium from being contaminated, it is also known, in the case of dispensing devices of the type in question, to provide a filter arrangement in the region of the pressure-equalizing channel, this filter arrangement using a bacteria filter to filter microbacteria out of the inflowing air.

The situation where medium passes as far as this bacteria filter cannot be ruled out in the case of dispensing devices of the type in question. This applies, in particular, to dispensing devices which, for use, are intended to be moved into a position which differs from their rest position, in which case the outlet opening, previously arranged at the top, is oriented downward. The pressure-equalizing channel, which in the rest position usually opens out into the medium reservoir above the liquid level, is then located beneath the liquid level during use. It is indeed the case that an air cushion usually remains between the medium and the bacteria filter when the dispensing device is turned over, and this air cushion prevents the liquid from coming into direct contact with the bacteria filter. However, in particular in the case of dispensing devices in which the medium in the medium reservoir is subjected to pressure in order for a dispensing operation to be carried out, it is also possible for the medium to come into contact with the bacteria filter.

This situation is very disadvantageous since the small pore size of the bacteria filter results in a high surface tension of the medium in these pores, which, even after the dispensing device has been transferred back into its rest position, results in this medium remaining on the bacteria filter. Due to the abovementioned surface tension, this medium then prevents air from entering into the medium reservoir, in which case it is no longer possible to compensate sufficiently for the medium which has been dispensed. An increase in pore size, however, is problematic since this would help bacteria to penetrate into the bacteria filter again.

OBJECT AND SOLUTION

It is an object of the invention to develop a dispensing device of the type in question to the extent where the abovementioned disadvantages of the prior art are avoided or reduced.

This is achieved according to the invention in that the filter arrangement has a liquid filter oriented in the direction of the medium reservoir and a bacteria filter oriented away from the medium reservoir. These two filters are arranged such that the air which flows through the pressure-equalizing channel for pressure-equalizing purposes has to pass through both filters. The liquid path along which the medium passes from the medium store to the dispensing opening during the dispensing operation is separate from the pressure-equalizing channel, in which case the exiting medium does not have to pass through the liquid filter and the bacteria filter in order to reach the dispensing opening.

The two filters are arranged one behind the other within the pressure-equalizing channel, in which case, when the pressure is equalized as intended, the inflowing air passes in the first instance through the bacteria filter and then through the liquid filter. Conversely, however, the liquid cannot reach the bacteria filter since it is already halted by the liquid filter.

The dispensing opening is preferably assigned an outlet valve which opens as from an opening overpressure, the liquid filter being designed such that medium which is in contact with the liquid filter cannot pass through the liquid filter at least up to this opening overpressure. Since the opening overpressure of the outlet valve also forms, at the same time, the maximum pressure which can occur in the medium reservoir, this ensures that no medium reaches the bacteria filter.

The liquid filter is preferably designed such that medium which is in contact with the liquid filter cannot pass through the liquid filter up to an overpressure of at least 0.5 bar, preferably up to an overpressure of at least 1.0 bar. Since, in the case of most dispensing devices, the maximum overpressure which is usually provided in the medium reservoir during a dispensing operation is less than 0.5 bar, but at least less than 1.0 bar, such a configuration of the liquid filter means that it is not possible for any medium to reach the bacteria filter even if the medium is in direct contact with the liquid filter, and subjected to pressure, during the dispensing operation.

Even if the liquid filter does not block off the liquid completely, it nevertheless reduces the pressure with which the liquid, after possibly passing through the liquid filter, is forced against the bacteria filter, and there is therefore no risk of the liquid penetrating into the pores of the bacteria filter. It is particularly advantageous for the abovedescribed filter arrangement to be used in dispensing devices which are intended to be changed in position, for example such that the mouth opening of the pressure-equalizing channel is located beneath the liquid level of the medium during use.

The filters may be designed as filters made of a porous material, for example a sintered material. Use may also be made of woven-fabric membranes and other filter materials.

A particularly advantageous configuration is one in which the liquid filter and the bacteria filter each have filter pores, the average size of the filter pores of the liquid filter being greater than the average size of the filter pores of the bacteria filter. Since the pore size significantly influences the surface tension of a liquid which is in contact with the filter and passes into the pores, and therefore the necessary differential pressure between the two sides of the filter for the purpose of detaching the liquid has to increase as the filter pores decrease, it is advantageous to provide larger pores on the liquid filter. If, after the dispensing device has been temporarily upended, a liquid layer remains on the liquid filter, the comparatively large pores mean that it can be detached from the filter even by a fairly low differential pressure between the external surroundings and medium reservoir.

An average pore diameter for the liquid filter of at least 6 μm has proven to be particularly advantageous. It is particularly advantageous if the liquid filter has an average pore diameter of greater than 10 μm, in particular greater than 15 μm. This comparatively large pore size results in an advantageously low surface tension at the liquid filter, in which case a liquid film on that side of the liquid filter which is directed away from the bacteria filter is reliably removed during pressure equalization and this therefore allows air bubbles then to enter for pressure-equalizing purposes.

As far as the bacteria filter is concerned, an average pore diameter of at most 5 μm, preferably of at most 1 μm, in particular of at most 0.2 μm has been found to be advantageous. Depending on the actual application purpose, any desired combinations of the given limit values may be expedient.

In a development of the invention, the liquid filter and the bacteria filter are spaced apart from one another, preferably by at least 1 mm. This spacing prevents the situation in which medium passing through the liquid filter comes into direct contact with the bacteria filter. Instead, a limited quantity of medium can pass, without having any adverse affect on the bacteria filter, into the region between the liquid filter and bacteria filter, from where this quantity of liquid is forced back into the reservoir during pressure equalization.

In a development of the invention, the liquid filter and the bacteria filter are part of a filter unit which is inserted into the pressure-equalizing channel. The filter unit can thus be handled as a single entity during assembly and can already predetermine the desired spacing between the liquid filter and the bacteria filter. The filter unit may also be inserted into the pressure-equalizing channel so as to form an extension of the pressure-equalizing channel. For this purpose, it is preferably of tubular design.

In a development of the invention, the pressure-equalizing channel is designed, at least in certain sections, as a capillary channel. Such a capillary channel hinders medium which has evaporated in the medium reservoir from exiting. A capillary channel here is considered to be a channel of at least 10 mm in length with an average cross-sectional surface area of smaller than 1 $mm^2$, preferably smaller than 0.5 $mm^2$. The provision of a capillary channel means that the pressure-equalizing channel does not have to be sealed in relation to the medium reservoir by a comparatively complex valve. This is advantageous, in particular, since such a valve is difficult to configure in respect of functioning pressure equalization.

DESCRIPTION OF THE EXEMPLARY EMBODIMENT

Figure 2A:
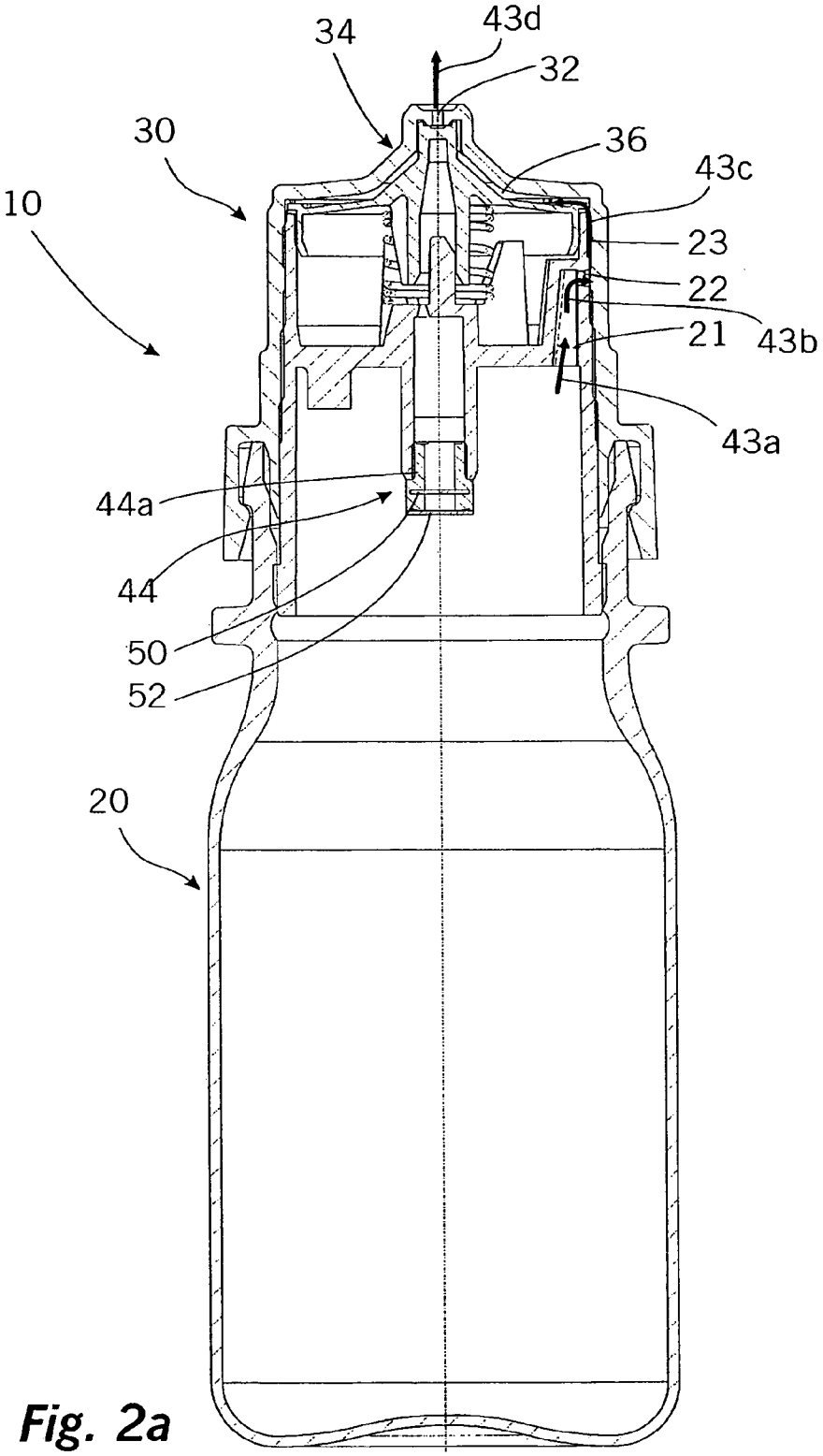
Figure 2B:
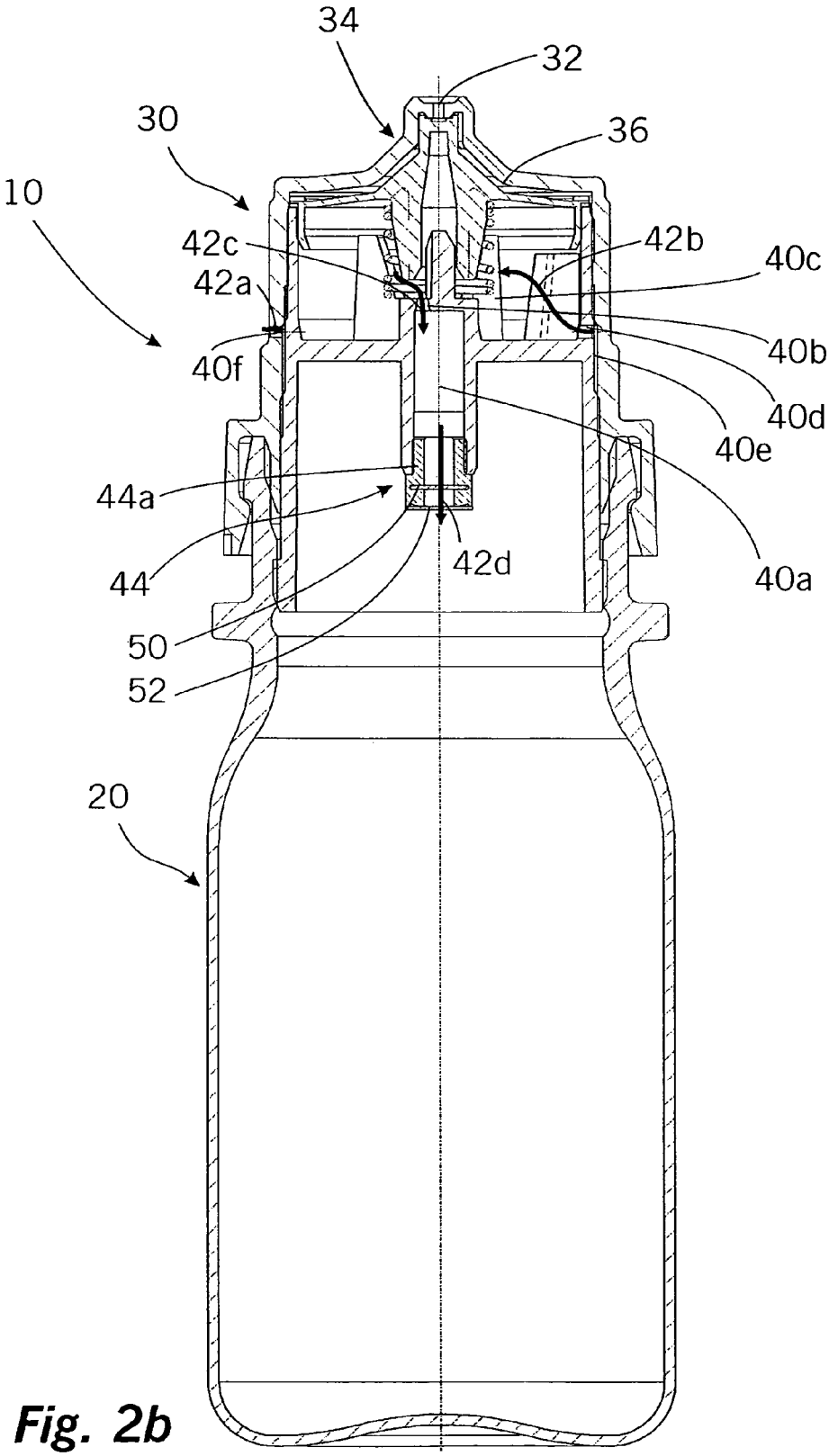

Further aspects and advantages of the invention can be gathered not only from the claims but also from the following description of two preferred exemplary embodiments of the invention, which will be explained with reference to the figures, in which:

FIG. 1 shows a sectional side view of a first embodiment of a dispensing device according to the invention, and FIGS. 2*a* and 2*b* show two sectional side views of a second embodiment of a dispensing device according to the invention.

FIG. 1 illustrates a dispensing device 10 which has a bottle-like medium reservoir 20 and a metering head 30 latched thereon.

The metering head 30 contains an outlet opening 32 which is closed by a valve 34 until the pressure in the medium in a valve chamber 36 connected to the medium reservoir has reached a predetermined level. As soon as this is the case, the valve 34 is pushed open by the liquid pressure, counter to a spring force, and the dispensing operation begins. In the case of the dispensing device 10 illustrated, provision is made for this device to be held, during the dispensing operation, such that the outlet opening 32 is oriented downward.

In the case of the dispensing device illustrated, the medium in the medium reservoir 20 is subjected to pressure by the medium reservoir 20 being compressed manually. The medium reservoir 20 is connected to the valve chamber 36 via a channel which is not illustrated in FIG. 1, in which case the compression of the medium reservoir 20 results in an increase in pressure both in the medium reservoir 20 and in the valve chamber 36. Alternative embodiments, however, may also provide some other kind of pressure-generating means, for example a piston pump arranged between the medium reservoir and the outlet opening 32.

The metering head 30 contains the pressure-equalizing channel 40 through which, along the arrows 42*a*, 42*b*, 42*c*, air can flow into the medium reservoir from the surroundings. This means that the previously dispensed quantity of liquid can be replaced by inflowing air, and this therefore re-establishes the normal pressure in the medium reservoir following a dispensing operation. The pressure-equalizing channel 40 serves merely to let in air. Liquid medium which is directed from the medium reservoir 20 to the valve chamber 36, and is dispensed through the dispensing opening 32, is not, for this purpose, guided through the pressure-equalizing channel 40 and the filters 50, 52, which will be described in more detail hereinbelow.

A filter unit 44 is pushed into the pressure-equalizing channel 40 and retained in the illustrated position by a press fit. This filter unit has a cylinder tube portion 44*a* in which two filters 50, 52 are arranged in cascade formation one behind the other. The inflowing air has to pass through both filters 50, 52 in order to reach the medium reservoir 20. The upper filter 50 is encapsulated by the plastics material of the tube portion 44*a*, whereas the lower filter is fastened on the end surface, for example by means of adhesive bonding.

The upper filter 50, as seen in relation to FIG. 1, is a bacteria filter, that is to say a filter which filters at least some contaminants out of the air. For this purpose, it is ideally produced from a porous material which has a pore size of 0.5 to 1.5 μm. Depending on the requirements which have to be met by the decontaminating action, other pore sizes may also be provided. The smaller the pore sizes of the bacteria filter, the more advantageous is the lower filter 52, which forms a liquid filter with an average pore size of approximately 15 μm. When the dispensing device is in an upended position, in which the outlet opening 32 is oriented downward, this liquid filter 52 prevents the medium in the medium reservoir 20 from being able to pass straight to the bacteria filter 50. Instead, it merely reaches the liquid filter 52, where at most a very small quantity of medium is forced through the liquid filter 52 when the medium is subjected to pressure. Even in such a case, however, this quantity of liquid is not sufficient in order to wet the entire surface area of the bacteria filter 50 or even to be able to penetrate into the pores of the bacteria filter 50.

As soon as the dispensing device, following a dispensing operation, is turned back again into its original position, which is illustrated in the figure, and the pressure to which the medium is subjected dissipates, the negative pressure which is then established in the medium reservoir 20 causes air to be taken in through the pressure-equalizing channel 40. A liquid film which may still be present on the liquid filter 52 is released from the filter 52 in this case. There is no need for any great negative pressure in the medium reservoir 20 for this purpose since the pores of the liquid filter 52 are comparatively large, in which case there is only a low level of surface tension on that side of the remaining liquid film which is oriented in the direction of the liquid filter.

Once the liquid film has been removed, the quantity of air which is necessary for pressure equalization can pass straight through the pressure-equalizing channel 40 into the medium reservoir 20. If liquid has passed between the filters 50, 52 beforehand, some of this is forced back into the medium reservoir 20.

The embodiment of FIGS. 2*a* and 2*b* is of largely identical construction to the embodiment of FIG. 1. However, since some aspects of this second embodiment are realized slightly differently and/or can be seen to better effect, these aspects of this second embodiment will be explained again. Unless mentioned to the contrary, the embodiments of FIGS. 1 and 2*a*/2*b* are of functionally identical construction.

FIGS. 2*a* and 2*b* show respectively different sectional planes through this second embodiment.

The sectional plane of FIG. 2*a* serves to elucidate the media path 43 along which, with the dispensing device in the upended position, the medium exits when the medium reservoir 20 has force applied to it. The medium here enters into the outlet channel 21, adjoining the medium reservoir 20, and from there passes out through a radial hole 22 and a narrow gap 23 into the valve chamber 36, out of which it is dispensed through the dispensing opening 32. The arrows 43*a* to 43*d* show this media path clearly.

The subsequent pressure equalization is elucidated with reference to the illustration of FIG. 2*b*. The pressure-equalizing channel 40 of this second embodiment has a somewhat different course than in the embodiment of FIG. 1. The pressure-equalizing channel, corresponding to the configuration of FIG. 1, has an axial channel portion 40*a*, which is connected to a valve counterchamber 40*c* by way of a hole 40*b*. This valve counterchamber 40*c* is connected to the surroundings via a radial hole 40*d*, an annular channel 40*e*, acting as capillary channel, and an inlet hole 40*f*. The negative pressure which is established in the medium reservoir 20 following a dispensing operation results in air flowing into the medium reservoir along this pressure-equalizing channel and along the arrows 42*a*-42*d*. The air here passes through the filters 50, 52 in the manner described in relation to the embodiment of FIG. 1.

The path 42*a*-42*d*, through which air flows into the medium reservoir 20 for pressure-equalizing purposes, and the media path 43*a*-43*d*, along which the liquid medium is discharged to the surroundings from the medium reservoir 20, are thus completely separate.

As is also the case with the embodiment of FIG. 1, the pressure-equalizing channel 40, 40*a*-40*f* is always open for the throughflow of air. However, the capillary-channel portion 40*e* effectively prevents the relevant quantities of the medium which have evaporated within the medium reservoir 20 from being able to pass out of the dispensing device 10.

The invention claimed is:

1. A dispensing device for a liquid medium comprising:

a reservoir having an open end; and a metering head having a first peripheral wall defining a liquid inlet sealing attached to the open end of the reservoir and a liquid outlet, the metering head including a second peripheral wall disposed within the first peripheral wall, the first and second peripheral walls defining a liquid passage extending between the open end of the reservoir and the liquid outlet, an opening extending from an exterior surface of the first peripheral wall defining a first vent passage, an annular passage disposed between the first and second peripheral walls defining a second vent passage, the second peripheral wall defining a third vent passage, the second vent passage fluidly connecting the first vent passage to the third vent passage, the third vent passage being connected to a filter unit having a first filter adjacent an interior of the reservoir and a second filter adjacent to the third vent passage, the first filter being separated from the second filter by a void space, the first filter preventing liquid from passing from the interior of the reservoir into contact with the second filter, the second filter preventing passage of bacteria from the third vent passage into the interior of the reservoir.

2. The dispensing device according to claim 1, wherein: the first filter is designed such that medium which is in contact with the first filter cannot pass through the first filter up to an overpressure of at least 0.5 bar.

3. The dispensing device according to claim 2, wherein the first filter is designed such that medium which is in contact with the first filter cannot pass through the first filter up to overpressure of at least 1.0 bar.

4. The dispensing device according to claim 2, wherein the first filter is designed such that medium which is in contact with the first filter cannot pass through the first filter up to an overpressure of at least 1.0 bar, and wherein the first filter and the second filter are spaced apart from one another by at least 0.5 mm.

5. The dispensing device according to claim 1, wherein: the first filter has an average pore size of at least 6 μm; and/or the second filter has an average pore size of at most 5 μm.

6. The dispensing device according to claim 1, wherein: the vent passages are arranged such that, in a rest position, the vent passages are arranged above a liquid level of the medium and, in a use position, the vent passages are arranged beneath the liquid level of the medium.

7. The dispensing device according to claim 1, wherein: the the annular passage is designed, at least in certain sections, as a capillary channel having a length of at least 10 mm and an average cross-sectional area of smaller than 1 $mm^2$.

8. The dispensing device of claim 1, wherein: the first filter and the second filter are spaced apart from one another by at least 0.5 mm.

9. The dispensing device of claim 8, wherein: the first filter is designed such that the medium which is in contact with the first filter cannot pass through the first filter up to an overpressure of at least 0.5 bar.

10. The dispensing device of claim 1, wherein: the first filter is designed such that the medium which is in contact with the first filter cannot pass through the first filter up to an overpressure of at least 1.0 bar.

11. The dispensing device of claim 1, wherein:

the medium does not pass through the first filter when moving from the reservoir to the liquid outlet.

* * * * *